166-274 SR
FIP7912 OR 4,034,810

United States Patent [19]
Holloway

[11] 4,034,810
[45] July 12, 1977

[54] OIL RECOVERY

[75] Inventor: Carl C. Holloway, Bartlesville, Okla.

[73] Assignee: Phillips Petroleum Company, Bartlesville, Okla.

[21] Appl. No.: 636,483

[22] Filed: Dec. 1, 1975

[51] Int. Cl.[2] ..... E21B 43/16
[52] U.S. Cl. ..... 166/274; 166/252
[58] Field of Search ..... 166/273, 274

[56] References Cited

U.S. PATENT DOCUMENTS

| | | | |
|---|---|---|---|
| 3,096,821 | 7/1963 | Dyes | 166/274 |
| 3,167,118 | 1/1965 | Habermann | 166/252 |
| 3,231,018 | 1/1966 | Handy | 166/274 |
| 3,386,506 | 6/1968 | Quance | 166/273 |
| 3,443,635 | 5/1969 | Gogarty et al. | 166/252 |
| 3,472,320 | 10/1969 | Dyes | 166/273 |
| 3,599,717 | 8/1971 | McMillen | 166/273 |
| 3,779,315 | 12/1973 | Boneau | 166/274 |
| 3,882,940 | 5/1975 | Carlin | 166/274 |

OTHER PUBLICATIONS

Dyes, "Where Are We Going With Miscible Displacement," The Petroleum Engineer, 2/61, pp. B-19-B-23.
Holloway et al., "Performance of a Miscible Flood With Alternate Gas-Water Displacement," Journal of Petroleum Technology, 4/64, pp. 372-376.

*Primary Examiner*—Ernest R. Purser

[57] ABSTRACT

The sweep efficiency of a two-phase gas/aqueous fluid in a formation is at a maximum when the volume ratio of gas to aqueous fluid corresponds to the minimum total mobility. By injecting gas and an aqueous liquid into a formation following a miscible flooding agent, the efficiency of the miscible flooding can be optimized.

8 Claims, 1 Drawing Figure

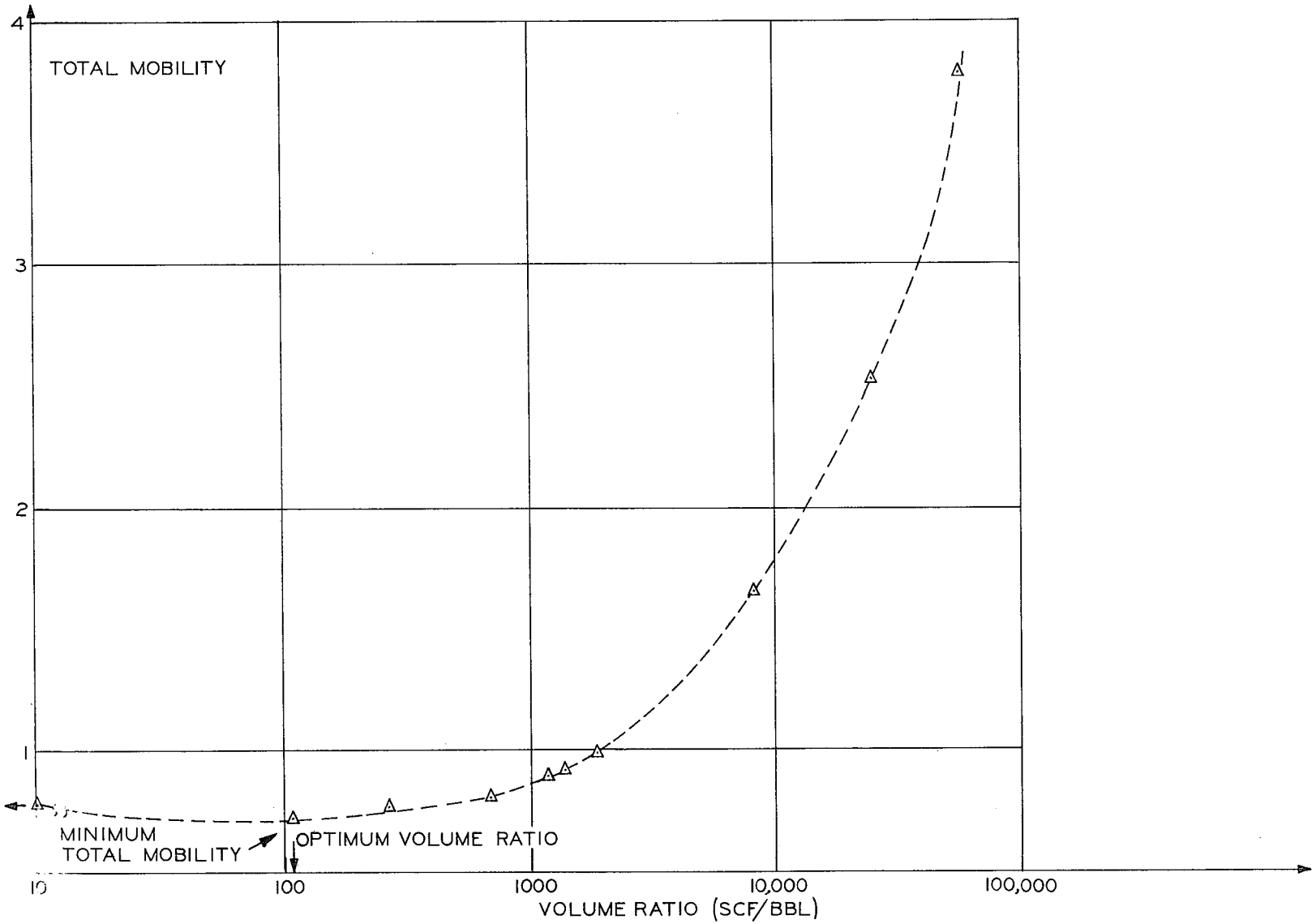
TOTAL MOBILITY
4
3
2
1
MINIMUM
TOTAL MOBILITY
OPTIMUM VOLUME RATIO
10
100
1000
10,000
100,000
VOLUME RATIO (SCF/BBL)

OIL RECOVERY

This invention relates to the recovery of hydrocarbons from formations. In one of its more specific aspects, this invention relates to oil recovery from formations by miscibly flooding the formation.

BACKGROUND OF THE INVENTION

It is known in the art that oil can be recovered from a subterranean formation by injecting a mixture of an oil-miscible fluid, such as natural gas, and water into the formation. The art discloses to inject gas and water into a formation in a ratio so that the two fluids flow in the formation at equal velocities. However, this manner of operating does not guarantee the highest possible sweep efficiency. It would, therefore, be desirable to have a process available by which the sweep efficiency of the flooding is futher improved.

THE INVENTION

It is thus one object of this invention to provide a process for oil recovery from subterranean formations. Another object of this invention is to provide a process for the recovery of oil from subterranean formations by gas-miscibly flooding the formation.

A further object of this invention is to provide an oil recovery process using gas-miscible flooding techniques and having both high sweep efficiency and low fingering.

These and other objects, embodiments, advantages, features and details of this invention will become apparent from the following detailed description of the invention, the appended claims, the example and the drawing which shows a diagram of the functional relationship between the total mobility and the gas-to-water volume ratio.

In accordance with this invention, there is provided an oil recovery process in which maximum sweep efficiency is achieved by introducing gas and an aqueous liquid into the formation to establish a two-phase gas-/aqueous liquid system in the formation. Gas and aqueous liquid are introduced in a volume ratio being approximately the optimum volume ratio. This optimum volume ratio is defined as that ratio of volume gas to volume aqueous liquid at which the total mobility of the two-phase gas/aqueous liquid system as a function of the ratio of volume gas to volume aqueous liquid has a minimum value. The total mobility is the sum of the gas mobility and the mobility of the aqueous liquid.

More specifically, and in accordance with a presently preferred embodiment, my invention consists in a process comprising injecting a fluid to miscibly displace oil via at least one injection well into a formation, subsequently injecting gas and aqueous liquid into said formation via at least one injection well, such as to provide a two-phase gas/aqueous liquid system in the formation, the volume ratio of gas to aqueous liquid being selected at the point of minimum total mobility.

Thus, in accordance with this invention, a core sample of the formation to be produced (flooded) is taken and the relative mobilities of gas and the aqueous liquid are determined for various volume ratios of gas to aqueous liquid. The total mobility, being the sum of the mobility of the gas and the mobility of the aqueous liquid, is established as a function of the various volume ratios of gas to aqueous liquid. Thereafter, that volume ratio of gas to aqueous liquid is determined for which this total mobility is at a minimum. This is the optimum volume ratio. Then, during the actual injection, gas and aqueous liquid are introduced into the formation either as a mixture or preferably as alternating slugs following the injection of an oil-miscible fluid slug so that the volume ratio of injected gas to injected aqueous fluid is approximately the optimum volume ratio.

The following definitions are given in order to help better understand the invention.

"absolute permeability": This is the capacity of a sample of the formation to transmit a fluid therethrough when the sample is completely saturated with the same fluid.

"Effective permeability": This is the capacity of the sample of the formation to transmit a fluid therethrough when the sample is only partially saturated with this fluid and partially saturated with another fluid.

"Relative permeability": This is the effective permeability of the sample divided by the absolute permeability of the same sample for one and the same fluid.

Both the absolute permeability and the effective permeability are determined in accordance with the procedures found in API RP27, Third Edition, September 1952, issued by American Petroleum Institute.

"Gas mobility":This is the relative permeability to the gas divided by the gas viscosity in centipoise.

"Water mobility": This is the relative permeability to the aqueous liquid divided by the viscosity of the aqueous liquid in centipoise.

"Total mobility": This is the sum of the gas mobility and the water mobility for a specific gas saturation and a specific saturation with the aqueous liquid that add up to 100%.

In accordance with this invention, any gas and any aqueous liquid that are compatible with the rest of the recovery process can be used. Examples for the gas that can be used are: flue gas, air, and natural gas, and mixtures of these gases. Examples for the aqueous liquid used in accordance with this invention are: fresh water and brine. The salt content of brines use will preferably be in the range of 100 ppm to 50,000 ppm total dissolved solids.

The gas and the aqueous liquid can be injected in the proper ratio simultaneously as a mixture. However, as indicated above, it is less expensive and therefore presently preferred to inject the gas the aqueous liquid in small slugs into the formation. The volume ratio of these slugs is again in accordance with this invention, the optimum volume-ratio and corresponds to the minimum total mobility. By "small slugs" the following is meant: The time between the switching from a gas slug to an aqueous liquid slug and vice versa has to be small as compared to the total travel time of these fluids from the injection well to the production well. Generally, the time mentioned will be in the order of days or weeks, whereas the total travel time for these fluids to be moved from an injection well to a production well is up to two years and longer, depending upon well spacing and other factors. The small slugs of gas and aqueous liquid mix in the formation to establish a two-phase area and since the minimum mobility ratio has been employed, a maximum sweep efficiency is reached. Furthermore, the fingering is reduced to a minimum.

In accordance with the preferred embodiment of this invention, the two-phase gas/aqueous liquid is established following an oil-miscible fluid in the formation. Examples for such oil-miscible fluids that are as such well known in the art are enriched natural gas and hydrocarbon liquids.

The invention will be still more fully understood from the following example.

EXAMPLE

Core samples from the Bridger Lake formation were taken and the gas and water mobility for various degrees of gas saturation were determined. The cylindrical samples were sealed at the cylindrical surface leaving only the flat top and bottom areas open for fluids to travel through these samples. The samples were saturated with salt water (salt concentration: 9000 ppm) and natural gas was thereafter pumped through the cores. The quantities of brine displaced, as well as the pressure drop, and the quantities of gas having traveled through the samples were determined. The relative permeability of the core sample to water, and respectively to gas as a function of the gas saturation, were determined in accordance with API RP27 cited above. The values obtained are shown in the first three columns of the following table. The viscosity of the gas $\mu_g$ used was 0.027 centipoise and the viscosity of the brine $\mu_w$ used was 0.264 centipoise. With these values the mobilities of gas $M_g$ and the mobility of brine $M_w$, as well as the total mobility $M_T = M_g + M_w$, were calculated. All these values are also shown in the following table. The volume ratio in SCF gas per bbl water being $1670 \times M_g/M_w$ is calculated and shown in col. 7 of the table. The numeral 1670 is the factor converting one barrel of gas at reservoir conditions into standard cubic feet.

| (1) | (2) | (3) | $(4) = \frac{(2)}{\mu_g}$ | $(5) = \frac{(3)}{\mu_w}$ | (6) = (4) + (5) | $(7) = 1670 \cdot \frac{(4)}{(5)}$ |
|---|---|---|---|---|---|---|
| $S_g$ | $K_{rg}$ | $K_{rw}$ | $M_g$ | $M_w$ | $M_T$ | Slug size ratio $\frac{SCF}{bbl}$ |
| .20 | 0 | .200 | 0 | .759 | .759 | 0 |
| .21 | .0012 | .183 | .0445 | .694 | .7385[a] | 107 |
| .22 | .0032 | .168 | .1184 | .636 | .7544 | 262 |
| .23 | .00631 | .151 | .234 | .572 | .806 | 684 |
| .24 | .0100 | .139 | .370 | .526 | .896 | 1175 |
| .2435 | .0114 | .133 | .422 | .506 | .928 | 1370 |
| .25 | .014 | .124 | .519 | .470 | .989 | 1842 |
| .30 | .0371 | .074 | 1.373 | .280 | 1.653 | 8200 |
| .35 | .064 | .043 | 2.37 | .163 | 2.533 | 24300 |
| .40 | .100 | .024 | 3.70 | .091 | 3.791 | 58000 |
| .45 | .150 | .0122 | 5.56 | .0462 | 5.6062 | 201000 |
| .50 | .209 | .00365 | 7.74 | .01382 | 7.75382 | 935000 |
| .54 | .270 | 0 | 10.0 | 0 | 10.0 | ∞ |

a= Min. total mobility

Col. (1) = $S_g$ = gas saturation.

Col. (2) = $K_{rg}$ = relative permeability to gas.

Col. (3) = $K_{rw}$ = relative permeability to aqueous liquid (salt water).

Col. (4) = $M_g$ = gas mobility = relative permeability to gas/gas viscosity = $\frac{(2)}{\mu_g}$ Col. (5) = $M_w$ = aqueous liquid mobility = relative permeability to aqueous liquid viscosity of aqueous liquid = $\frac{(3)}{\mu_w}$ Col. (6) = $M_T$ = total mobility to aqueous liquid and gas = (4) + (5).

Col. (7) = $1670 \cdot \frac{\text{Col. 4}}{\text{Col. 5}}$ $1670 \cdot \frac{M_g}{M_w} = \frac{\text{volume rate for gas (SCF)}}{\text{volume rate of water (bbl)}} =$ volume ratio of gas to aqueous fluid.

$\frac{SCF}{bbl}$ = cubic feet of gas/barrels of aqueous liquid at standard conditions.

In the table above it can be seen that the minimum total mobility $M_T$ of 0.7385 occurs at a volume ratio of 107 gas/bbl water. This result can also be seen from the figure, which shows a graphic diagram of similogarithmic paper of the values of the total mobility as a function of the volume ratio of gas (SCF) to salt water (bbl).

Using these results obtained in the laboratory, an actual field operation can be calculated as follows bases on a volume ratio of 110 SCF gas (for ease of calculation) per bbl water.

Assuming an injection of $10^6$ SCF gas per day and 800 bbl water per day, the ratio of number of days $N_g$ in which gas is injected into the formation and the number of days $N_w$ during which salt water is injected into the formation is calculated from $$1000000\ N_g / 800\ N_w = 110$$

or $$N_w = 11.4\ N_g$$

This result means one could inject gas at $10^6$ SCF per day for 5 days and water at a rate of 800 bbl per day for 57 days and then repeat this injection sequence.

Correspondingly, if gas would be injected into one well and brine would be injected into another well, and after a certain number of days the operation would be switched so that water would be injected into the well into which gas had been injected and vice versa, the injected volumes per day have to be adjusted as follows:

$$Q_g N / Q_w N = 110$$

or $$q_g(\text{SCF}) = 110\ Q_w(\text{bbl})$$

In this formula $Q_g$ is the volume of gas in SCF injected per day, $Q_w$ is the volume of salt water in barrels per day injected into the formation, an N is the number of days during which this injection is carried out. Thus, injecting 800 bbl of water into one injection well per day would mean that 88,000 SCF of gas per day would have to be injected into the other well.

Other combinations for more wells and more complicated systems can be calculated, the only condition in accordance with this invention being that the two-phase gas/aqueous liquid system established behind the miscibly flooding agent has a volume ratio corresponding to the minimum total mobility of gas and aqueous liquid as defined. Reasonable variations and modifications that will become apparent to those skilled in the art can be made from this invention without departing from the spirit and scope thereof.

I claim:

1. A process for the recovery of oil from subterranean formations comprising:

a. injecting an oil-miscible fluid into the formation via at least one injection well to miscible displace oil, b. injecting gas and an aqueous liquid via at least one injection well into the formation to establish a two-phase gas/aqueous liquid system in the formation following said oil-miscible fluid under the provision that said gas and aqueous liquid are injected into said formation at a volume ratio which corresponds to a minimum total mobility and which is defined as that volume ratio of gas to aqueous liquid for which the total mobility for the two-phase gas/aqueous liquid system as a function of said volume ratio is at a minimum value, c. moving at least a portion of said oil-miscible fluid through the formation followed by said two-phase gas/aqueous liquid system and into at least one production well, and d. recovering oil-containing fluid from said production well.

2. A process in accordance with claim 1 wherein gas and aqueous liquid are injected as slugs alternately into at least one injection well, with the provision that the volume ratio of these slugs is approximately said optimum volume ratio.

3. A process in accordance with claim 1 wherein gas and aqueous liquid are injected into at least one injection well in the form of a mixture.

4. A process in accordance with claim 1 wherein gas is injected into at least one injection well for a given time and said aqueous liquid is simultaneously injected via at least one other injection well for the same given time, with the further provision that the total flow volume ratio of gas to aqueous liquid is approximately said optimum volume ratio.

5. A process in accordance with claim 1 wherein salt water is injected as said aqueous liquid into at least one injection well.

6. A process in accordance with claim 1 in which natural gas is injected into said injection well.

7. A process in accordance with claim 1 wherein said fluid is rich natural gas.

8. A process in accordance with claim 1 wherein said gas is natural gas and said aqueous liquid is salt water.

* * * * *